US005464321A

United States Patent [19]

Williams et al.

[11] Patent Number: 5,464,321

[45] Date of Patent: Nov. 7, 1995

[54] MARINE PROPELLER

[75] Inventors: Robert M. Williams, Chantilly; Ernest O. Rogers, Great Falls, both of Va.; Maurice M. Sevik, Potomac, Md.

[73] Assignee: The United States of America as represented by the Secretary of the Navy, Washington, D.C.

[21] Appl. No.: 964,237

[22] Filed: Nov. 24, 1978

[51] Int. Cl.[6] ..... B63H 1/14; B63H 1/18

[52] U.S. Cl. ..... 416/93 A; 416/93 R; 440/66

[58] Field of Search ..... 115/34 R, 34 A; 416/20 R, 20 B, 90 A, 231 R, 93 R, 93 A; 440/66

[56] References Cited

U.S. PATENT DOCUMENTS

| | | | |
|---|---|---|---|
| 606,986 | 7/1898 | Carter et al. | 416/20 B |
| 2,511,156 | 6/1950 | Glass | 115/34 R X |
| 2,705,051 | 3/1955 | Hauser | 416/20 B |
| 3,385,374 | 5/1968 | Kaplan et al. | 416/20 B |
| 3,406,759 | 10/1968 | Nutku | 416/20 B |

FOREIGN PATENT DOCUMENTS

| | | | |
|---|---|---|---|
| 1198145 | 8/1965 | Germany | 416/20 |
| 27581 | of 1913 | United Kingdom | 416/20 B |

*Primary Examiner*—Charles T. Jordan
*Assistant Examiner*—Christopher K. Montgomery

[57] ABSTRACT

A marine propeller using the circulation control principle of blowing tangentially over a Coanda surface at the trailing edge of each blade to develop high blade lift (thrust). Each blade has internal chambers and two blowing slots so that blowing is controllable for forward and for reverse thrust without reversing rotational direction of the propeller. This propeller is capable of generating much greater thrust and ship speed at lower RPM and noise levels than conventional propellers.

3 Claims, 1 Drawing Sheet

MARINE PROPELLER

The invention described herein may be manufactured and used by or for the Government of the United States of America for governmental purposes without the payment of any royalties thereon or therefor.

BACKGROUND OF THE INVENTION

The instant invention relates generally to marine screw propellers and more particularly to a propeller using the circulation control principle of blowing tangentially over a coanda surface to develop higher than usual thrust as well as to control the direction of that thrust.

Marine screw propellers used in the propulsion of vessels such as ships, submarines, and the like generally have a fixed pitch and are designed primarily for forward propulsion. In order to stop the ship or to back it, it is necessary to reverse the rotation of the propeller. The procedure and machinery for stopping and backing large ships is extensive. Either the reduction gear requires a reverse gear, or a reversing engine or turbine must be provided. Stopping and backing of a ship is very time consuming and therefore must be anticipated by the conning officer because of the time involved. The complete propulsion machinery system including the propeller, propeller shaft, reduction gear, and turbine or engine must be brought to a complete stop while the ship coasts. Then the propeller rotation and therefore its thrust is reversed by reversing all the propulsion machinery.

In applications where propeller thrust reversal is required repeatedly and rapidly, such as in ice breaking operations, reversible pitch propellers have been devised. These propellers are not particularly efficient because of their shape and the necessary protuberances of the variable pitch mechanism.

Regarding propeller efficiency and noise reduction, prior work has focused on blade form and means to reduce or eliminate cavitation. Previous attempts to reduce cavitation involve discharging air or water from the back or the trailing edge of the blades to merely fill the vacuum void, and not to increase the thrust produced by the blade.

SUMMARY OF THE INVENTION

Accordingly, a primary object of the instant invention is to provide a new and improved marine propeller.

Another object of the present invention is to provide a marine propeller capable of greater thrust and ship speed at lower RPM than conventional propellers.

Still another object of the instant invention is to provide a marine propeller having low noise radiation.

A further object of the instant invention is to provide a marine propeller that has reversible thrust without reversing rotational direction or pitch.

A still further object of the instant invention is to provide a marine propeller that can generate large forward and reverse thrust for easy and rapid maneuverability.

Still another object of the instant invention is to provide a marine propeller capable of very rapid thrust reversal without rotational direction change.

Briefly, these and other objects of the instant invention are attained by the use of a propeller using the circulation control principle of blowing over a Coanda surface at the trailing edge of the blades to develop higher lift (thrust). By providing another set of blowing slots on the pressure side of the trailing edges, reverse thrust is obtained for stopping and backing the ship without changing rotational direction of the propeller or the propeller pitch.

BRIEF DESCRIPTION OF THE DRAWINGS

A more complete understanding of the invention and many of the attendant advantages thereof will be readily appreciated as the same becomes better understood by reference to the following detailed description when considered in connection with the accompanying drawing wherein.

DESCRIPTION OF THE PREFERRED EMBODIMENT

Figure 1:
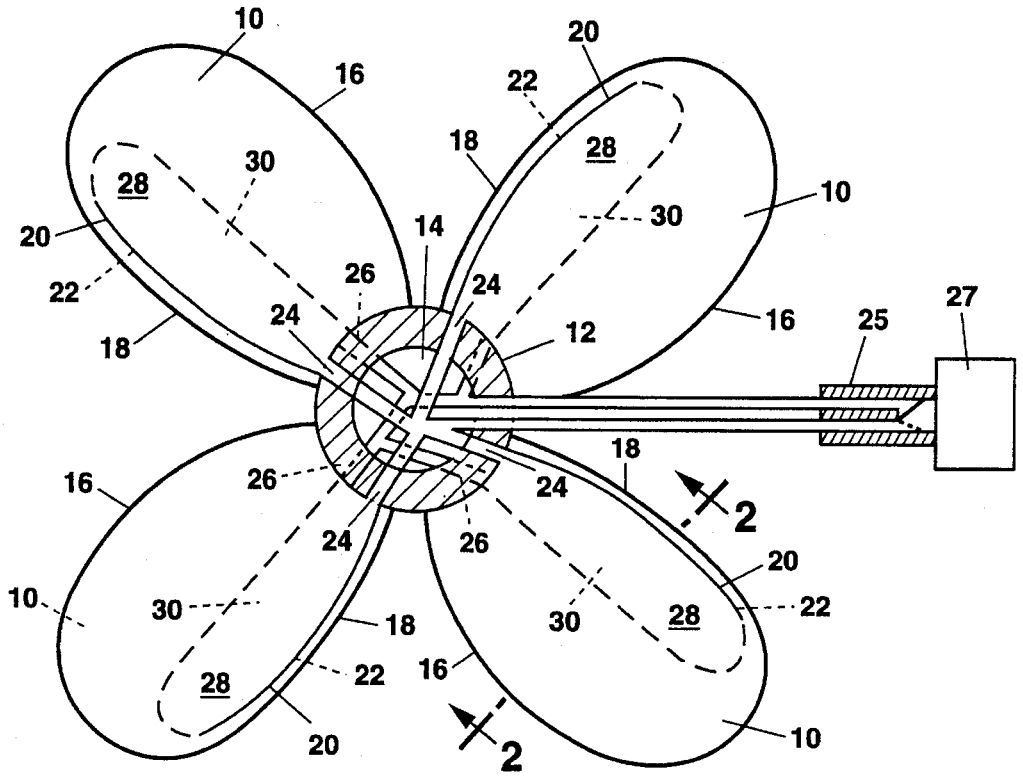
FIG. 1 is a rear elevational view of a marine propeller according to the invention.

Referring now to the drawings wherein like reference numerals designate corresponding parts throughout the several views, there is shown generally in FIG. 1 a marine propeller having a plurality of blades 10 radially projecting from a hub 12. The hub 12 has a bore 14 for attachment to a propeller shaft (not shown) by any conventional means. Blades 10 have a leading edge 16 and a trailing edge 18. The trailing edge is two internal chambers 28 and 30 and a coanda surface for both a forward thrust blowing slot 20 on the suction side of the blade and a reverse thrust blowing slot 22 on the pressure side of the blade. The hub 12 is bored out to contain a plurality of conduits 24 and 26 communicating between ducts 11 and 13 in the propeller shaft and the respective chambers in the blades. A diverter valve 25 is connected to a source of fluid under pressure 27 for selectively directing the fluid to the appropriate duct depending on the desired direction of the thrust. As shown diagrammatically in FIG. 1, the valve 25 is dislaced from the hub 12 for clarity of illustration, however, it is to be understood that, in practice, the valve 25 could be enclosed within the hub. Communication of the conduits with chambers in each blade will be described in further detail hereinafter.

Figure 2:
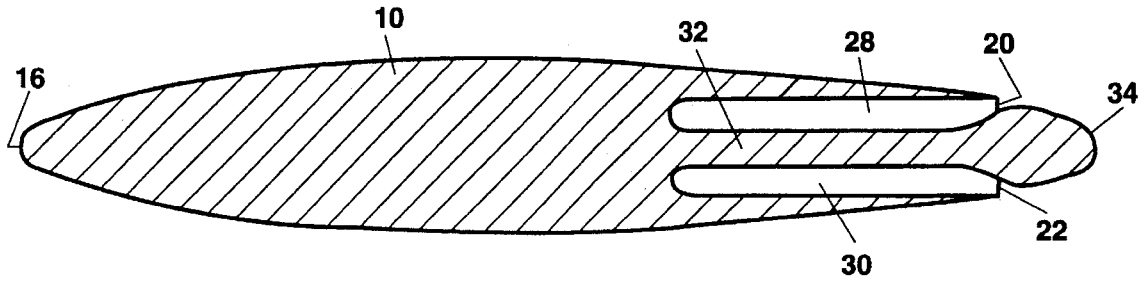
FIG. 2 is a chord sectional view taken across one blade.

Referring now to FIG. 2, one of the blades 10 is sectioned to show the blade having a forward thrust chamber 28 communicating with the forward blowing slot 20, and a reverse thrust chamber 30 communicating with the reverse blowing slot 22. A separator 32, having an integrally formed blunt trailing edge 34, acts as a Coanda surface and separates the upper and lower chambers as well as the upper and lower blowing slots 20 and 22. As seen in FIG. 1, the forward thrust chamber 28 communicates with the conduit 24 in the hub 12 and the reverse thrust chamber 30 communicates with conduit 26 in the hub 12 to provide fluid connections from a source of water (not shown) under pressure to be ejected from the slot 20 or 22.

In operation, the marine propeller attached to the propeller shaft at the stern of a ship is rotated in the normal manner. Using this invention it is possible to eliminate some of the conventional propulsion machinery such as the reversing gears in the reduction gear, or the reversing engine or turbine. The propeller blades 10 are affixed to the hub 12 at a predetermined pitch designed for optimum forward thrust, but capable of producing reverse thrust when circulation control blowing is applied.

Forward thrust is augmented using the principle of circulation control blowing out slots 20 on the suction side of the blades at the trailing edge 18 of the blades 10. Water, the medium in which the ship travels is placed under pressure and is conducted by suitable means to the propeller hub 12 through conduits in the propeller shaft for example. The fluid then passes through a plurality of conduits 24 in the hub which directs the fluid to chambers 28 in each of the blades. The water then is discharged tangentially to the suction surface out the forward thrust slots 20 and over a Coanda surface formed by the rounded trailing edge 34 of the separater 32. The surrounding medium boundary layer follows or is energized by the slot blowing thus delaying flow separation.

To effect reverse thrust by the propeller without a change in rotational direction, the flow to the forward thrust chambers 28 and slots 20 is cut off and diverted to the reverse thrust chambers 30 and thence out the slots 22. Again the fluid is discharged tangentially to to the pressure surface over the Coanda surface of the trailing edge 34. The flow path continues around the Coanda surface to separate from the blade at an angle opposite to and greater than the pitch angle, and thus reversing the thrust of the blades.

If desired, the blowing of the forward thrust slots and thus the propeller thrust may be modulated in accordance with changes in thrust as sensed by a thrust sensor, for example, in the wake of the ship. Thus modulation is possible because of the ability of this arrangement to rapidly vary propeller thrust.

Obviously many modifications and variations of the present invention are possible in light of the above teachings. It is therefore to be understood that within the scope of the appended claims, the invention may be practiced otherwise than as specifically described.

What is claimed is:

1. A marine propeller using circulation control blowing for increased thrust and reversing comprising:

a propeller shaft;

a hub for attachment to said propeller shaft;

a plurality of fixed propeller blades connected to and radiating from said hub;

a pair of chambers in each blade extending from the hub end to the distal end;

a forward thrust blowing slot in the trailing edge of said blades substantially tangent to the suction surface of each of said blades;

a reverse thrust blowing slot in the trailing edge of each of said blades substantially tangent to the pressure surface of said blades;

a separator between said pair of chambers and said forward and reverse blowing slots;

said separator having a rounded trailing edge forming a Coanda surface over which water from said forward and reverse thrust blowing slots flows;

all of said blowing slots being operative with said propeller rotating in one direction;

means for conducting the water to said blowing slots; and means for selecting the blowing slot to receive the water.

2. The marine propeller of claim 1 wherein said means for conducting the water comprises:

conduits in said hub communicating with said pair of chambers in each of said blades; and said means for selecting the slot comprises a diverter valve connected to said conduits and remotely located from the propeller.

3. The marine propeller of claim 1 wherein said means for conducting the flow of water to said blowing slots comprises:

a conduit in said hub communicating with said pair of chambers in each of said blades; and a diverter valve interposed between said conduit and said pair of chambers at the junction of said blades with said hub.

* * * * *